US008474420B2

(12) United States Patent
Stolk et al.

(10) Patent No.: US 8,474,420 B2
(45) Date of Patent: Jul. 2, 2013

(54) VARIABLE COMPRESSION RATIO INTERNAL COMBUSTION ENGINE WITH DISPLACEABLE CYLINDER HEAD AND CYLINDER HOUSING

(75) Inventors: Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 13/441,863

(22) Filed: Apr. 7, 2012

(65) Prior Publication Data

US 2012/0210984 A1 Aug. 23, 2012

Related U.S. Application Data

(63) Continuation-in-part of application No. PCT/EP2010/004705, filed on Jul. 31, 2010.

(30) Foreign Application Priority Data

Oct. 8, 2009 (DE) ..... 10 2009 048 716

(51) Int. Cl.
*F02B 75/04* (2006.01)

(52) U.S. Cl.
USPC ..... 123/48 C; 123/78 C

(58) Field of Classification Search
USPC ..... 123/48 C, 48 R, 78 C, 78 R
See application file for complete search history.

(56) References Cited

U.S. PATENT DOCUMENTS

| | | | | |
|---|---|---|---|---|
| 1,280,058 | A * | 9/1918 | Martin | 123/316 |
| 5,025,757 | A * | 6/1991 | Larsen | 123/48 R |
| 5,443,043 | A * | 8/1995 | Nilsson et al. | 123/48 C |
| 5,611,301 | A * | 3/1997 | Gillbrand et al. | 123/48 C |
| 6,880,499 | B2 * | 4/2005 | Hoffmann et al. | 123/48 C |
| 8,122,860 | B2 * | 2/2012 | Kamiyama et al. | 123/48 C |
| 8,136,489 | B2 * | 3/2012 | Kamiyama et al. | 123/48 C |
| 2010/0163002 | A1 * | 7/2010 | Kamiyama | 123/48 C |
| 2012/0017876 | A1 * | 1/2012 | Sawada et al. | 123/48 C |

FOREIGN PATENT DOCUMENTS

| | | | |
|---|---|---|---|
| AT | 414 017 | | 8/2006 |
| DE | 198 41 381 | | 5/1999 |
| EP | 0 560 701 | | 9/1993 |
| EP | 1 505 276 | | 2/2005 |
| EP | 1 762 415 | | 3/2007 |
| JP | 55 064131 | | 11/1978 |
| JP | 60022030 | A * | 2/1985 |

* cited by examiner

*Primary Examiner* — Noah Kamen
*Assistant Examiner* — Grant Moubry
(74) *Attorney, Agent, or Firm* — Klaus J. Bach

(57) ABSTRACT

In an internal combustion engine for a motor vehicle, comprising a crankcase and a crankshaft accommodated therein, and a cylinder housing including at least one cylinder with a cylinder head, the cylinder housing with the cylinder head is supported directly on the crankshaft via eccentric elements which are pivotable for adjusting a position of the cylinder housing with the cylinder head relative to the crankshaft with the crankcase (12) for changing the compression ratio of the engine.

7 Claims, 3 Drawing Sheets

VARIABLE COMPRESSION RATIO INTERNAL COMBUSTION ENGINE WITH DISPLACEABLE CYLINDER HEAD AND CYLINDER HOUSING

This is a Continuation-In-Part application of pending international patent application PCT/EP2010/004705 filed Jul. 31, 2010 and claiming the priority of German patent application 10 2009 048 716.6 filed Oct. 8, 2009.

BACKGROUND OF THE INVENTION

The invention relates to an internal combustion with an adjustable compression ratio.

In conventional internal combustion engines, the position of the piston in the cylinder of the internal combustion engine depends exclusively on the position of the crankshaft. In other words, such internal combustion engines have a fixed compression ratio. Under certain operating conditions, however, it is be advantageous to have a variable compression ratio. Several concepts are known in this context.

In a particular embodiment of such internal combustion engines with a variable compression ratio, the connecting rod is divided into two parts, the relative position of which can be changed by means of a link arm in order to adjust the relative position between the piston and the crankshaft while changing the compression ratio. The disadvantage of such connecting rods is that they have a higher mass than known single-part connecting rods. This increases the moving mass of the engine, resulting in a higher load and weight.

Another known solution is the mounting of the crankshaft in eccentric supports, so that the crankshaft is displaceable relative to the crankcase. This, too, allows the position of the dead centers of the piston movement to be changed, so that an internal combustion engine with a variable compression ratio can be implemented. Such an internal combustion engine is for example known from DE 198 41 381 A1. Such systems have the disadvantage that, by changing the relative position of the crankshaft when adjusting the compression ratio, the position of the output shaft of the internal combustion engine is displaced as well. This requires complex structures for transmitting the drive torques from the internal combustion engine to further components of the drive train.

From EP 1 505 276 A1, an internal combustion engine with a variable compression ratio is known wherein the relative position between the cylinder block and the crankcase can be adjusted by means of an eccentric mechanism which comprises a plurality of eccentric elements mounted on a control shaft. Unfortunately, such a mechanism places a high load on the eccentric shaft arrangement mounted between the crankcase and the cylinder housing, which however requires a high strength structure of the crankcase for transmitting forces to the crankshaft and additional measures for the lubrication of the control shaft.

From EP 1 762 415 A1, an internal combustion engine is known which comprises an arrangement similar to that of EP 1 505 276 A1 for adjusting the compression ratio. For this purpose, the position of the cylinder housing relative to the crankcase can be changed by means of two eccentric shafts located in an upper section of the crankcase for moving the cylinder housing relative to the crankcase. In each case however the crankcase must be of a high strength design so as to be capable of transmitting the high forces effective during the compression and the power strokes of the engine between the cylinder head and the crankcase.

It is the object of the present invention to provide an internal combustion engine in which the distance between the cylinder head and crankshaft is adjustable in such a way that the compression ratio of the internal combustion engine can be adjusted by extremely simple means and without the need for a high-strength crankcase design.

SUMMARY OF THE INVENTION

In an internal combustion engine for a motor vehicle, comprising a crankcase and a crankshaft accommodated therein and a cylinder housing with a cylinder head, the cylinder housing with the cylinder head is supported directly on the crankshaft via eccentric elements which are pivotable for adjusting a relative position between the cylinder housing with the cylinder head and the crankshaft with the crankcase for changing the compression ratio of the engine.

According to the invention, the eccentric element is pivoted on the crankshaft. The forces generated when adjusting a relative position between the cylinder housing and the crankcase are therefore absorbed by the crankshaft, which is already designed to withstand such forces. An adequate lubrication of the crankshaft is also provided for in standard internal combustion engines, so that there is no need for additional lubrication for the eccentric adjustment. Such an internal combustion engine can therefore be implemented with a minimum of additional components. The moving masses of such an internal combustion engine, in particular, are not increased, so that operating loads remain low. Owing to the fixed relative position of the crankshaft and the crankcase, there is further no need for an additional gearbox on the output side for the transmission of the drive torques to the drive train. As a whole, the result is a particularly simple mechanism for adjusting the compression ratio of the crankshaft, which can be implemented cost-effectively while being operationally reliable.

To ensure the seal tightness of the internal combustion engine, a further development of the invention is provided with a flexible sealing element between the cylinder block and the crankcase.

This sealing element is preferably in the form of a bellows. It ensures that oil and blow-by gases cannot escape from the connection interface between the cylinder block and the crankcase.

In order to ensure a substantially vertical movement of the cylinder block while the eccentric element is being adjusted, the latter is preferably further supported by a momentum support arrangement which guides the cylinder block relative to the crankcase.

Preferably, a plurality of eccentric elements is further provided, which are pivoted on a plurality of and in particular on all of the journals of the crankshaft. As a result forces are introduced evenly over the entire length of the crankshaft during operation and during the adjustment of the compression ratio, so that the crankshaft is not subjected to any buckling loads.

The invention will become more readily apparent from the following description of particular embodiments thereof and its embodiments are explained in greater detail below with reference to the accompanying drawings:

DESCRIPTION OF A PARTICULAR EMBODIMENT

Figure 1:
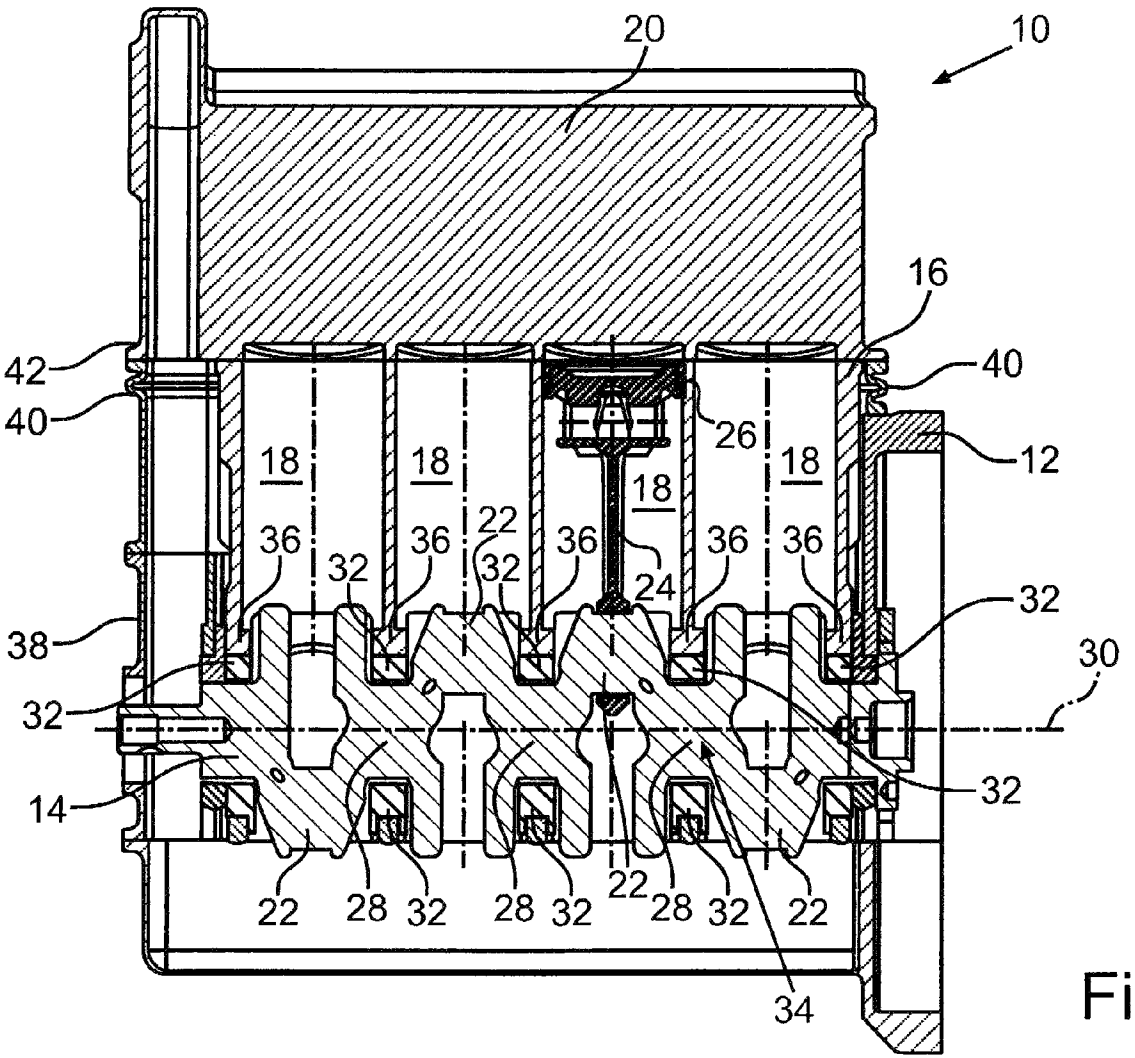
FIG. 1 is a longitudinal section through an embodiment of an internal combustion engine according to the invention.

The internal combustion engine for a motor vehicle, which is identified by the reference number 10 as a whole, comprises a crankcase 12 in which a crankshaft 14 is accommodated. A cylinder housing 16 with four cylinders 18 is movable relative to the crankcase 12. Towards the top, the cylinder housing 16 ends in a cylinder head 20. Connecting rods 24 which support the pistons 26 are supported on the crank pins 22 of the crankshaft via bearings. For clarity, FIG. 1 shows only one connecting rod 24 and one piston 26. The crankshaft 14 converts the up and down movements of the combination of connecting rods 24 and pistons 26 into rotary motion. Between two crank pins 22 of the crankshaft, journals 28 are arranged. In contrast to the crank pins 22, these are coaxial with the axis of rotation of the crankshaft 14. The journals 28 are encompassed by eccentric elements 32, the through-openings 34 of which simultaneously form the bearing openings for the crankshaft 14. The eccentric elements 32 are accommodated in openings of walls 36 of the cylinder housing 16.

By adjusting the eccentric elements 32, the combination of cylinder housing 16 and cylinder head 20 is displaced relative to the crankcase 12. This changes the relative position of the top and bottom dead centres of the piston movement, so that the compression ratio of the internal combustion engine 10 can be adjusted by adjusting the eccentric elements 32. In order to ensure that the assembly comprising the crankcase 12, the cylinder housing 16 and the cylinder head 12 remains oil-tight, an outer wall 38 of the crankcase 12 is joined to an outer wall 42 of the cylinder head by a bellows 40. The bellows 40 seals the cylinder head against the crankcase 12 at any setting of the eccentric elements 32. In order to change the setting of the eccentric elements 32—and thus the compression ratio of the internal combustion engine 10—an actuator not shown in the drawing is provided. Another component which is not shown is a momentum support which ensures a substantially vertical relative movement of the cylinder housing 16 and the cylinder head 20 relative to the crankcase 12 while the eccentric elements are being adjusted.

Figure 3:
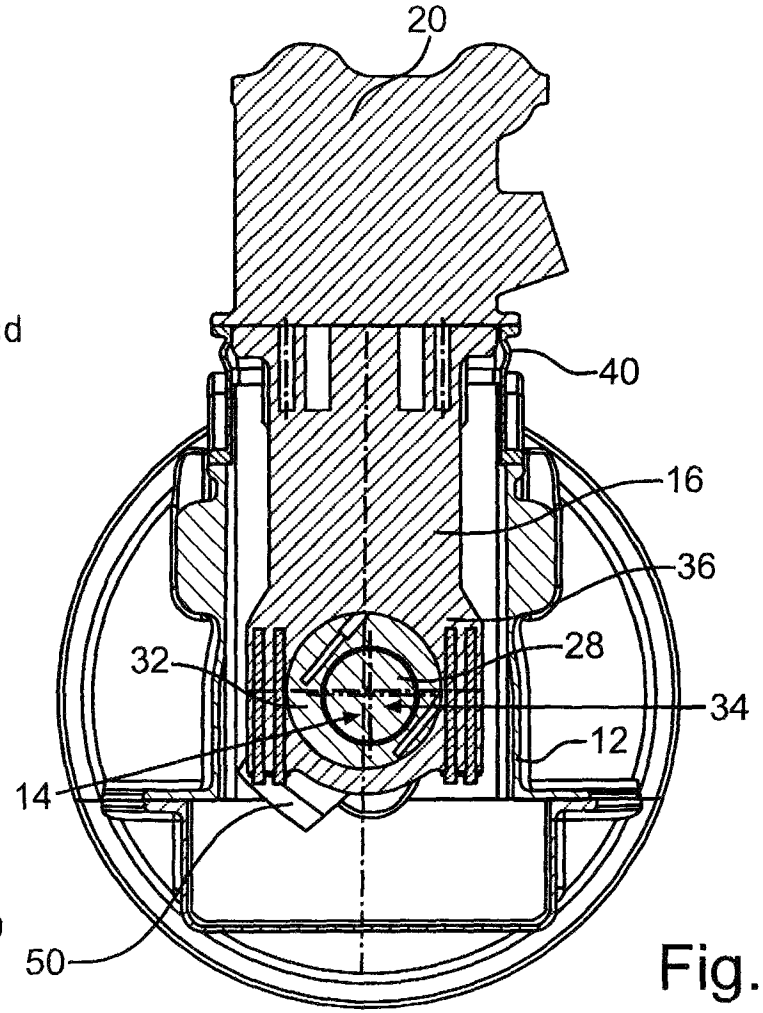
FIG. 3 is a cross-section through the internal combustion engine according to FIG. 1 at the level of a journal of the crankshaft at a low compression ratio.
Figure 2:
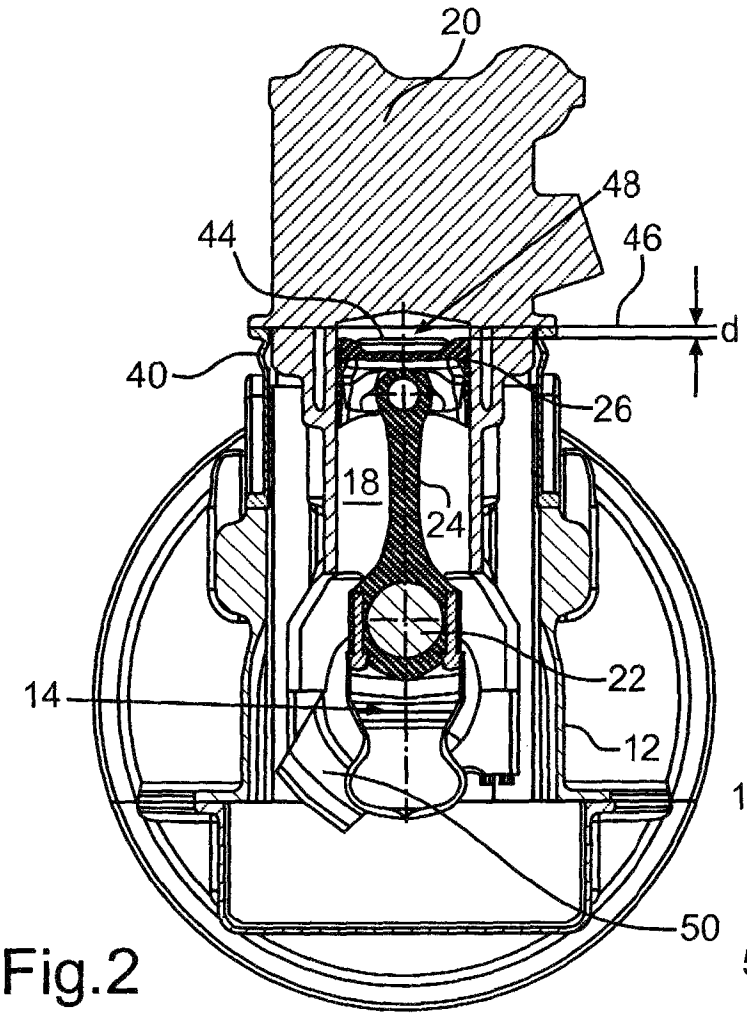
FIG. 2 is a cross-section through the internal combustion engine according to FIG. 1 at the level of a crank pin of a crankshaft of the internal combustion engine at a low compression ratio.

FIGS. 2 and 3 are cross-sections through the internal combustion engine at an eccentric setting for a low compression ratio. The sections are at the level of the crank pin 22 and the journal 28 of the crankshaft 14 respectively. As FIG. 2 shows, at this setting the piston 26 is not in a maximally retracted position at top dead center. On the contrary, the piston crown 44 of the piston 26 is at a distance from the maximally retracted position identified by the line 46. The compression volume 48 of the cylinder 18 is therefore larger, resulting in a low compression ratio. Owing to the position of the eccentric element 32, the cylinder housing 16 and the cylinder head 20 are in this position displaced in the upward direction by the distance d relative to the crankcase 12. The bellows 40 is in its extended position. For adjustment, the eccentric element 32 has an application element 50 on which the actuator not shown in the drawing can act. It should be noted that the journal 28 of the crankshaft 14, which is accommodated in the through-opening 34 of the eccentric element 32, does not change its position in this process. The position of the crankshaft 14 relative to the crankcase 12 is therefore fixed, so that torque can be transmitted to other components of the drive train without any problems.

Figure 5:
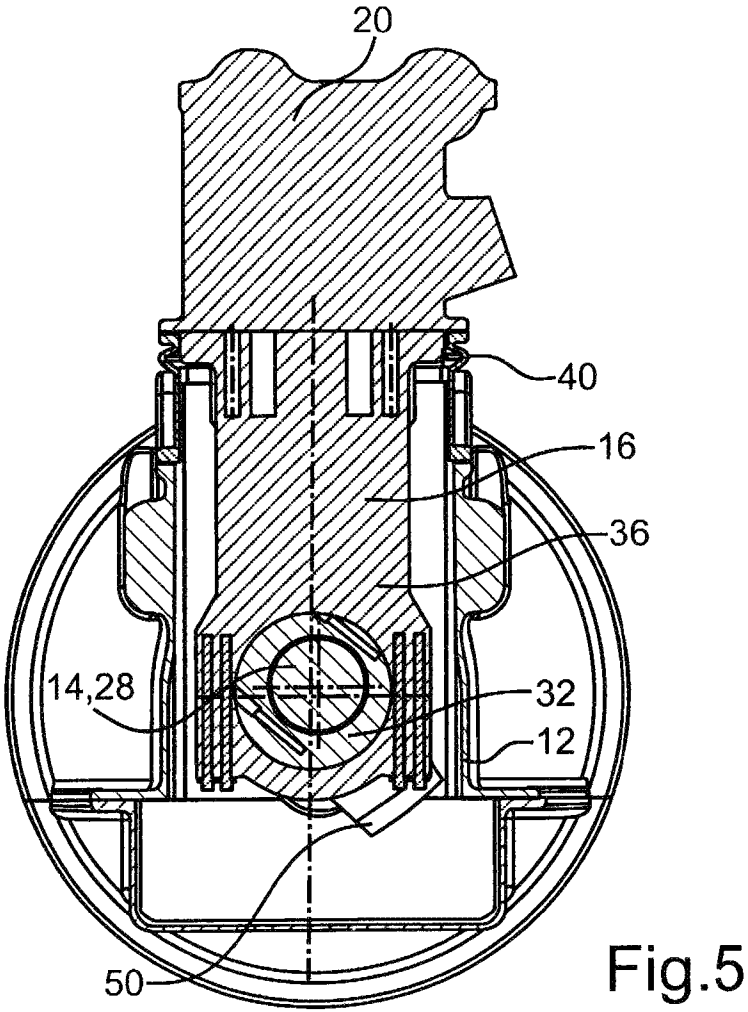
FIG. 5 is a cross-section through the internal combustion engine according to FIG. 1 at the level of a journal of the crankshaft at a high compression ratio.
Figure 4:
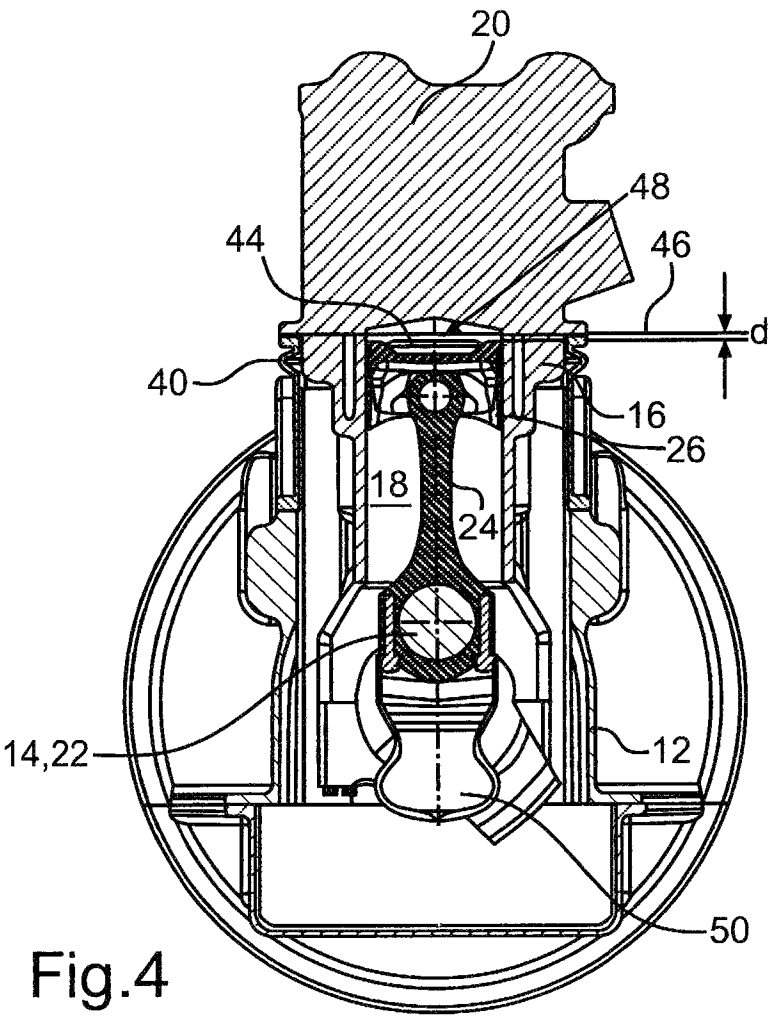
FIG. 4 is a cross-section through the internal combustion engine according to FIG. 1 at the level of a crank pin of the crankshaft at a high compression ratio.

FIGS. 4 and 5 show the same cross-sections, but with the eccentric element 32 set for a high compression ratio. Compared to FIGS. 2 and 3, the combination of cylinder housing 16 and cylinder head 20 is displaced in a downward direction relative to the crankcase 12. The piston crown 44 of the piston 26 is close to its maximally retracted position identified by the line 46. Owing to the shorter distance d between the piston crown 44 and this maximum position 46, a particularly small compression volume and therefore a high compression ratio is ensured. In this position, the journals 28 of the crankshaft 14 are not displaced, maintaining their fixed position with respect to the crankcase 12. All intermediate positions between the maximum positions shown in FIGS. 2 to 5 are of course possible. By means of the eccentric element 32, the compression ratio of the internal combustion engine 10 is therefore infinitely variable and can be optimally adapted to prevailing operating conditions.

LISTING OF REFERENCE NUMERALS

10 Internal combustion engine
12 Crankcase
14 Crankshaft
16 Cylinder housing
18 Cylinder
20 Cylinder head
22 Crank pin
24 Connecting rod
26 Piston
28 Journal
30 Axis of rotation
32 Eccentric element
34 Through-opening
36 Wall
38 Outer wall
40 Bellows
42 Outer wall
44 Piston crown
46 Line
48 Compression volume
50 Application element

What is claimed is:

1. An internal combustion engine (10), comprising a crankcase (12) and a crankshaft (14) supported in the crankcase (12), a cylinder housing (16) with at least one cylinder (18) provided with a cylinder head (20), and at least one eccentric element (32) provided for adjusting a relative position between the cylinder housing (16) and the crankcase (12), the eccentric element (32) being rotatably supported on the crankshaft (14) and directly supporting the cylinder housing (16) with the cylinder head (20), the cylinder housing (16) and the cylinder head (20) being movable relative to the crankshaft (14) and the crankcase (12) by rotation of the eccentric element (32) while the position of the crankshaft (14) with respect to the crankcase (12) remains fixed.

2. The internal combustion engine (10) according to claim 1, wherein a flexible sealing element (40) is provided between the crankcase (12) and one of the cylinder housing (16) with the cylinder head (20).

3. The internal combustion engine (10) according to claim 2, wherein the flexible sealing element (40 is a bellows.

4. The internal combustion engine (10) according to claim 1, wherein at least one momentum support is provided between the crankcase (12) and one of the cylinder head (20) and the cylinder housing (16).

5. The internal combustion engine (10) according to claim 1, wherein a plurality of eccentric elements (32) is provided, each of the eccentric elements (32) being pivotable on associated journals (28) of the crankshaft (14).

6. The internal combustion engine (10) according to claim 5, wherein an eccentric element (32) is provided on each journal (28) of the crankshaft (14) for supporting the cylinder housing (16) with the cylinder head (20) on the crankshaft (14).

7. A motor vehicle comprising an internal combustion engine (10) having an internal combustion engine (10) comprising a crankcase (12) and a crankshaft (14) supported in the crankcase (12), a cylinder housing (16) with at least one cylinder (18) including a cylinder head (20), the cylinder housing (16) and at least one eccentric element (32) for adjusting a relative position between the cylinder housing (16) and the crankcase (12), the eccentric element (32) being pivotally supported directly on the crankshaft (14) and supporting the cylinder housing (16) with the cylinder head (20) so that the cylinder housing (16) and the cylinder head (20) are movable relative to the crankshaft (14) and the crankcase by rotation of the eccentric element while the position of the crankshaft (14) with respect to the crankcase (12) remains fixed.

* * * * *